US005133085A

United States Patent [19]

de Pasquale Amicarelli et al.

[11] Patent Number: 5,133,085

[45] Date of Patent: Jul. 28, 1992

[54] NURSING SHIELD

[76] Inventors: Paula A. de Pasquale Amicarelli, 8107 West River Rd., Novelty, Ohio 44072; Grace M. de Pasquale, 4400 Norma Dr., South Euclid, Ohio 44121

[21] Appl. No.: 716,114

[22] Filed: Jun. 17, 1991

[51] Int. Cl.[5] ..... A41D 1/20

[52] U.S. Cl. ..... 2/69.5; 2/2; 2/104; 2/16; 2/20; 2/267

[58] Field of Search ..... 2/69.5, 2, 104, 16, 2/20, 267

[56] References Cited

U.S. PATENT DOCUMENTS

| | | | |
|---|---|---|---|
| 2,417,888 | 3/1946 | Schuster | 2/104 |
| 3,483,575 | 12/1969 | McCarthy | 2/69.5 |
| 4,004,294 | 1/1977 | Pinch | 2/104 |
| 4,031,566 | 6/1977 | Johnson | 2/104 |
| 4,106,122 | 8/1978 | Dodd | 2/104 |
| 4,468,816 | 9/1984 | Kaufer | 2/104 |
| 4,567,611 | 2/1986 | Kendrick | 2/104 |
| 4,631,754 | 12/1986 | Ryan | 2/104 |
| 4,651,349 | 3/1987 | Heiler | 2/104 |
| 4,712,251 | 12/1987 | Cobble | 2/49 R |
| 4,924,528 | 5/1990 | Trombetti-Dickens | 2/104 |
| 4,964,172 | 10/1990 | Bollard | 2/104 |
| 4,989,268 | 2/1991 | Stolhand | 2/104 |
| 5,005,217 | 4/1991 | Bern et al. | 2/104 |
| 5,008,960 | 4/1991 | Hemming | 2/104 |
| 5,042,090 | 8/1991 | Cook | 2/104 |

*Primary Examiner*—Werner H. Schroeder
*Assistant Examiner*—Gloria Hale
*Attorney, Agent, or Firm*—L. S. Van Landingham, Jr.

[57] ABSTRACT

A nursing shield for mothers who wish to nurse an infant discreetly or camouflage the act of nursing in a public setting. In a preferred embodiment, the nursing shield comprises a stiff yet flexible padded and covered panel which attaches to the back side of either the left or right forearm of a nursing mother and stands outward therefrom during use. Left hand and right hand finger-loops are provided to enable a nursing mother to flex the nursing shield with either hand for the purpose of increasing privacy. The inner side of the forearm attached to the nursing shield is free to directly contact the infant, and the mother's remaining arm and hand are free to prepare for nursing, make changes or adjustments during nursing, and generally comfort the infant. The nursing shield is washable and it may be folded for alternate use as a clutch bag, or laid flat on a supporting surface for use as a diaper changing pad.

18 Claims, 4 Drawing Sheets

NURSING SHIELD

THE BACKGROUND OF THE INVENTION

1. The Field Of The Invention

This invention broadly relates to nursing covers of shield-like design which are referred to herein as nursing shields. In some of its more specific aspects, the invention is concerned with nursing shields of novel design, construction and function for use by mothers who wish to nurse an infant discreetly or camouflage the act of nursing. The invention further relates to nursing shields which are capable of alternate use for other purposes such as clutch bags or diaper changing pads.

2. The Description Of The Prior Art

A number of prior art articles of clothing are known which are intended to facilitate nursing, but are not designed to conceal the breast area and infant during nursing. These include the articles of clothing disclosed in U.S. Pat. No. 4,004,294 issued Jan. 25, 1977 to L. Pinch, U.S. Pat. No. 4,031,566 issued Jun. 28, 1977 to M. Johnson, U.S. Pat. No. 2,417,888 issued Mar. 25, 1946 to C. A. Schuster, and U.S. Pat. No. 4,106,122 issued Aug. 15, 1978 to L. M. Dodd. A number of other prior art articles of clothing are known which are specifically designed to aid mothers in nursing discreetly, but they all have certain disadvantages. For example, U.S. Pat. No. 4,924,528 issued May 15, 1990 to P. Trombetti-Dickens discloses a bib for nursing mothers which is unflattering and contrary to fashion trends, and U.S. Pat. No. 4,468,816 issued Sep. 4, 1984 to S. Kaufer discloses a nursing garment which drapes over the shoulder and may be pushed away by an active infant during nursing leaving the breast area exposed. U.S. Pat. No. 4,567,611 issued Feb. 4, 1986 to S. Kendrick is for a nursing vest designed to be worn over other clothing, and it does not allow the mother to clearly see the infant's face during nursing. U.S. Pat. No. 4,631,754 issued Dec. 30, 1986 to B. Ryan is for a trapezoidal nursing scarf and U.S. Pat. No. 4,712,251 issued Dec. 15, 1987 to D. Cobble is for a nursing blanket which attaches to the mother's shoulder, and each of the garments disclosed in these two patents is bib-like, unflattering in appearance and subject to fashion trends. U.S. Pat. No. 4,651,349 issued Mar. 24, 1987 to J. K. Heiler is for a breast feeding sling which attaches around both the neck and arm of the mother, and the sling is restrictive of movement and obtrusive when in use.

All of the above-described prior art articles intended to facilitate nursing are based on designs which hang from the neck or shoulder, and thus they are seen as mother's garments. They are also constructed of soft fabrics which are incapable of standing upright or of being attached to the mother's arm so as to stand upright. The prior art devices do not allow freedom of movement, nor do they disguise or camouflage the act of nursing by giving the appearance of an infant's wrap or carrier. Many of the prior art devices also are not designed or effective to conceal the breast area and infant during nursing, nor do they provide privacy for mothers who wish to nurse discreetly in a public setting. Additionally, the prior art nursing devices are not suitable for alternate use for other purposes such as a clutch bag for carrying articles needed by the mother and infant, or for use as a diaper changing pad.

The aforementioned and other deficiencies and disadvantages of the prior art articles and devices that are intended to facilitate nursing have been long recognized by nursing mothers. However, an entirely satisfactory alternative thereto was not available prior to the present invention.

SUMMARY OF THE INVENTION

The present invention overcomes the deficiencies and disadvantages of the prior art articles of clothing and other devices intended to facilitate nursing which are discussed hereinbefore. This is accomplished by providing a nursing shield for use in the discreet breast feeding of an infant and in camouflaging the act of nursing which is characterized by the novel design, construction and functions described and claimed hereinafter.

In one presently preferred embodiment, the nursing shield comprises a stiff yet flexible panel. The panel and the nursing shield comprising the panel have an inner side which faces toward a nursing mother during use, an outer side which faces away from a nursing mother during use, and left, right, upper and lower portions with respect to a nursing mother during use Attaching means is provided for attaching the nursing shield to the mother's forearm, and it is constructed and arranged whereby during use the back side of the mother's forearm is adjacent the inner side of the nursing shield thereby leaving the inner side of the forearm free to directly contact the infant during nursing. The panel is sufficiently stiff to cause the attached nursing shield to stand out from the mother's forearm, and it is sufficiently flexible to allow a nursing mother to flex the shield toward the breast area and infant for greater concealment and privacy. The nursing shield is of sufficient size and has a construction and configuration whereby it is capable of concealing the mother's breast area and the infant's head and upper body when in use.

In some of its more specific embodiments, the nursing shield may be attached by means of a plurality of spaced upright elastic straps which are constructed and arranged whereby the nursing shield may be attached interchangeably to either the left or right forearm. Left and right hand finger-loops may be provided which are constructed and arranged whereby a nursing mother may use either the left or right hand to flex the nursing shield toward the breast area and the infant for greater Concealment and privacy. The inner and outer sides of the panel may be provided with padding for enhancing the comfort of the infant, and additional padding may be positioned around the left, right and upper peripheral portions of the nursing shield to provide an elongated raised peripheral pillow construction which increases concealment and privacy during nursing. A decorative cover may be provided over the inner and outer side of the nursing shield. The panel may be sufficiently flexible to allow it to be folded upon itself, and cooperating fastening means may be provided around the peripheries of the left, right, upper and lower portions of the nursing shield whereby when not in use it may be folded upon itself and fastened in the folded position to form an internal compartment for use in storing and transporting articles needed by the mother or infant. Lower upright left and right portions of the panel may be folded inward onto the inner side to form left and right upright pleats which cause the left and right portions of the inner side of the nursing shield to be raised and cupped inward to increase concealment and privacy during use. A foraminated polyolefin plastic panel may be used such as polyethylene or polypropylene plastic mesh or screen.

THE OBJECTS AND ADVANTAGES OF THE INVENTION

The principal objects and advantages of the present invention are to provide a nursing shield: to conceal the nursing mother's breast area from public view and camouflage the act of nursing and preparation for nursing; to provide a design and construction for a nursing shield which stands upright from the mother's arm and is clearly not a mother's garment and therefore not subject to the same restrictive fashion trends; to provide a shield-like nursing cover which gives the appearance of a baby wrap or carrier, thus disguising the act of nursing; to provide privacy and comfort for the nursing mother and infant as well as convenience and decreased expense as the invention may be used with any clothing; to provide a nursing shield which may be used for other purposes, such as a design and construction which may be folded and fastened in the folded position to serve as a clutch bag; to provide a design and construction which may be used as a diaper changing pad when not in use as a nursing shield; and to provide a nursing shield having the above advantages and other advantages including free viewing of the infant by the mother, freedom of movement by the mother, secure attachment of the nursing shield to the forearm so that it cannot easily be pushed away by an active infant thereby revealing the breast area, air circulation for the infant's comfort and breathing, comfortable and convenient use on either arm without regard to the mother's size, and easy donning and transferring of the nursing shield from one arm to the other for privacy while nursing from either breast.

THE BRIEF DESCRIPTION OF THE ACCOMPANYING DRAWINGS

The invention will be described hereinafter in greater particularity with reference to the presently preferred embodiments thereof which are illustrated in the accompanying drawings, wherein.

THE DETAILED DESCRIPTION OF THE INVENTION

Figure 1:
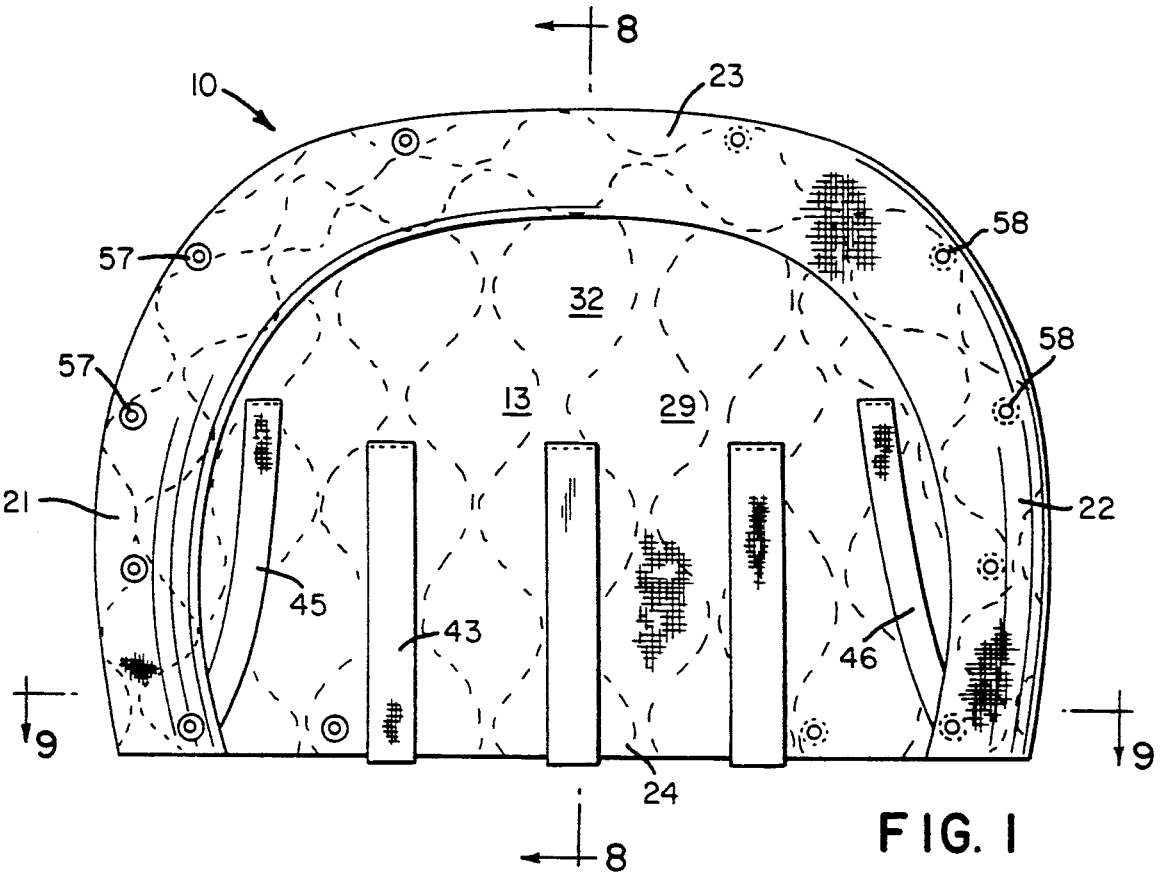
FIG. 1 is a plan view of the inner side of the nursing shield of the invention.
Figure 2:
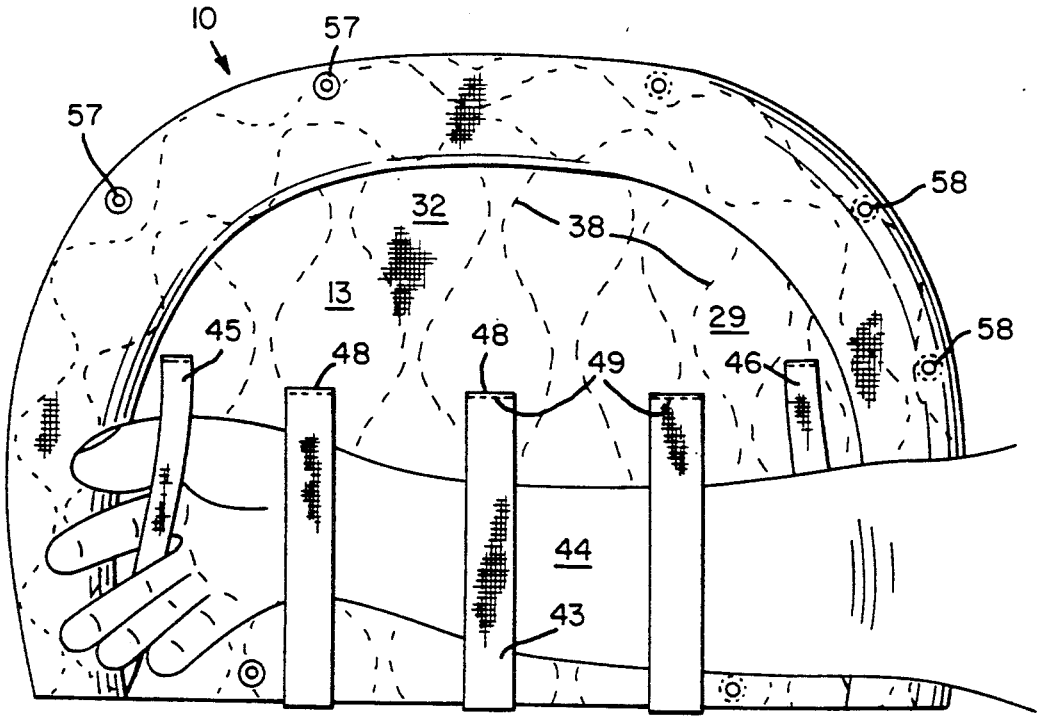
FIG. 2 is a plan view of the inner side of the nursing shield of the invention similar to that of FIG. 1, but further illustrating a mother's right forearm inserted through the attaching straps and with the thumb and forefinger of the right hand inserted through the finger-loop for the right hand.
Figure 3:
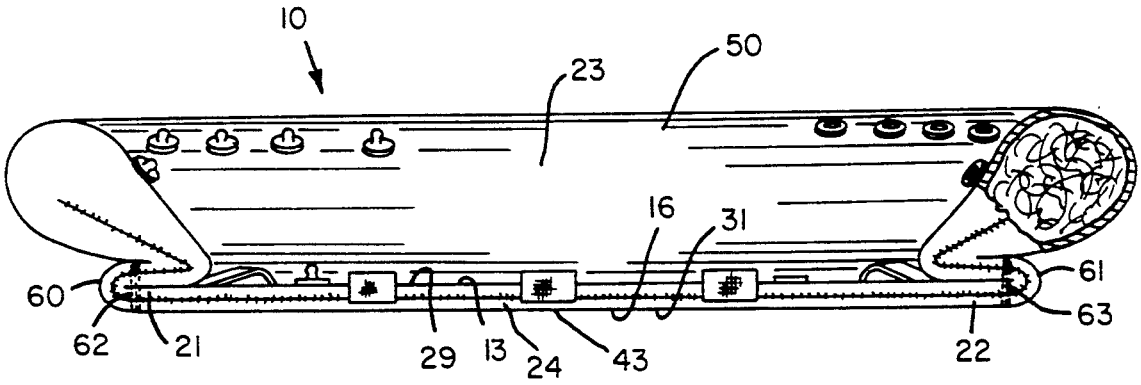
FIG. 3 is a side view of the nursing shield of the invention when viewed from the lower portion and looking toward the upper portion thereof.
Figure 4:
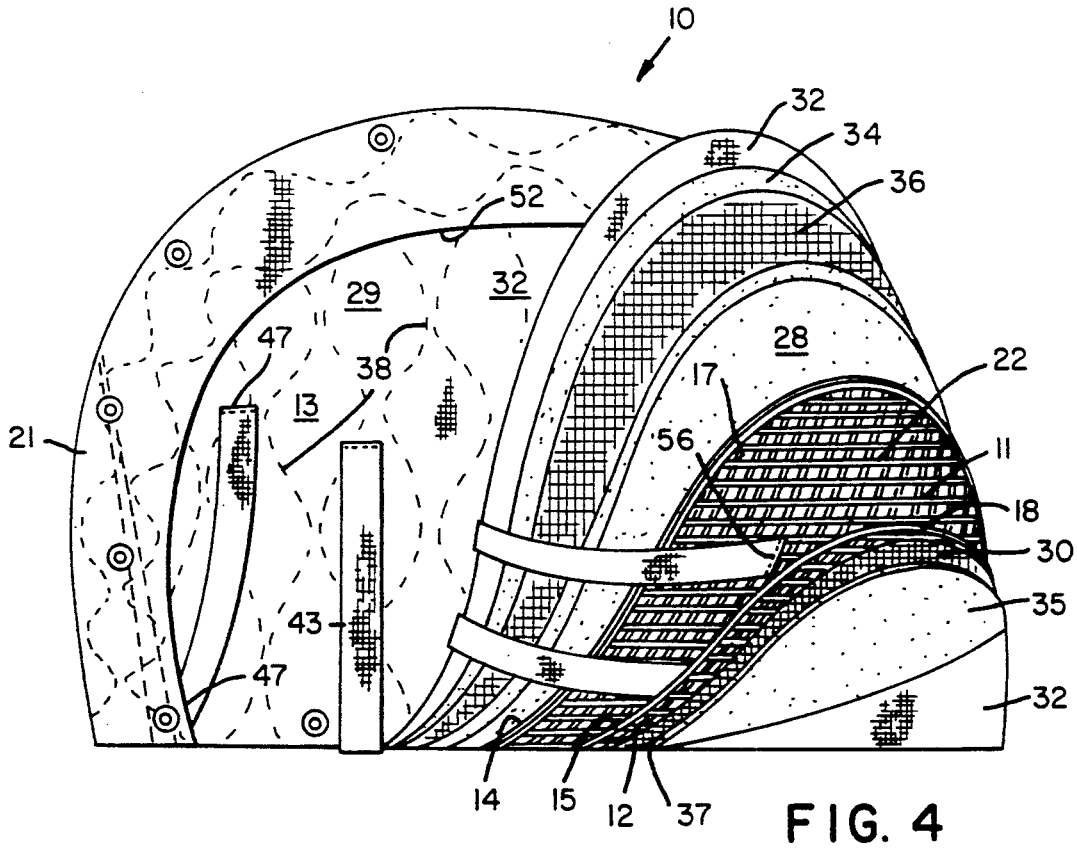
FIG. 4 is a diagrammatic exploded view of the nursing shield of the invention illustrating various elements thereof and their manner of attachment.
Figure 5:
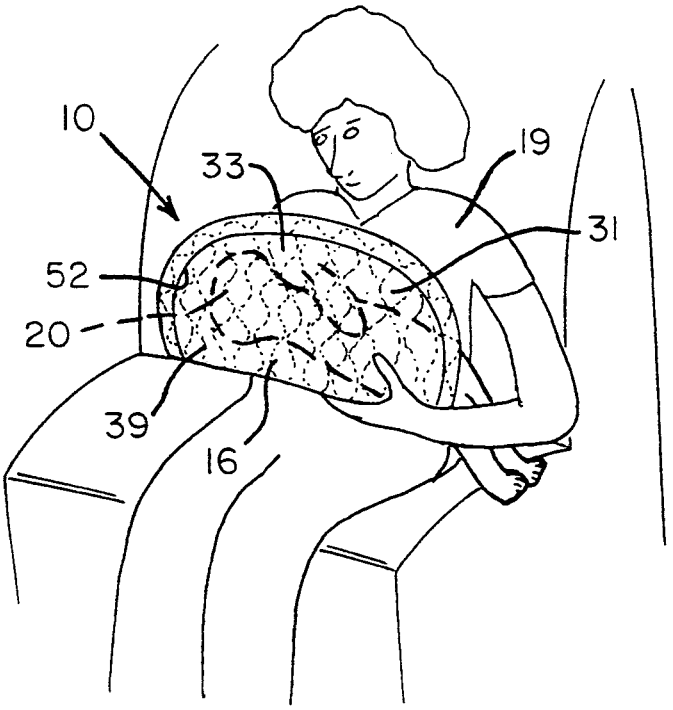
FIG. 5 is a perspective view illustrating the use of the nursing shield of the invention by a nursing mother and infant.

Referring now to FIGS. 1–9 of the drawings, the nursing shield 10 of the invention comprises first and second panels 11 and 12, respectively. The nursing shield 10 and the panels 11 and 12 have inner sides 13, 14 and 15, respectively, and outer sides 16, 17 and 18, respectively. As is best seen in FIGS. 4 and 5, the inner sides 13, 14 and 15 face toward a nursing mother 19 and infant 20 during use of nursing shield 10, and the outer sides 16, 17 and 18 face away from nursing mother 19 and infant 20. As is best seen in FIGS. 1, 4 and 5, the nursing shield 10 and the panels 11 and 12 also each have left portions 21, right portions 22, upper portions 23 and lower portions 24 in the vicinity of the points represented by the lead lines to their respective numerals.

The outer side 17 of panel 11 extends over and is in contact with the inner side 15 of panel 12, and the panels 11 and 12 are positioned between padding layers 28 and 30. The padding layer 28 extends over the inner side 14 of panel 11 and the padding layer 30 extends over the outer side 18 of panel 12. A layer of soft padded quilted fabric 29 extends over the inner side 13 of nursing shield 10, and a similar layer of soft padded quilted fabric 31 extends over the outer side 16 of nursing shield 10. As is best seen in FIG. 4, the quilted fabric layers 29 and 31 each comprise a decorative fabric layer 32 and 33, a padding layer 34 and 35, and a gauze backing layer 36 and 37 which are held in place by quilting stitching 38 and 39, respectively. The panels 11 and 12, the padding layers 28 and 30, and the quilted fabric layers 29 and 31 preferably have substantially the same size, and the size thereof may be substantially the same as sides 13 and 16 of nursing shield 10. The panels 11 and 12, the padding layers 28 and 30, the quilted fabric layers 29 and 31, and the nursing shield 10 prepared therefrom, preferably have a generally semi-circular configuration such as that illustrated in the drawings. It is understood that the term "semi-circular" or "generally semi-circular" is intended to cover semi-elipitical and similar configurations.

A plurality of spaced upright elastic straps 43 which extend upward from the lower portion 24 of the inner side 13 of the nursing shield 10 are provided for attaching the nursing shield 10 to the forearm 44 of a nursing mother 19. A right hand finger loop 45 and a left hand finger loop 46 are provided on the inner side 13 of nursing shield 10. The attaching straps 43 are so constructed and arranged that the right forearm of nursing mother 19 as illustrated may be inserted under straps 43 from right to left, or interchangeably the left forearm of nursing mother 19 may be inserted under straps 43 from left to right in a manner analogous to that illustrated for right forearm 44. When the nursing shield 10 is attached to the right forearm 44, the right hand is used to pull or release finger-loop strap 45 and thereby cause the nursing shield 10 to be flexed as desired toward or away from the breast area and the infant for greater concealment, making adjustments and the like. Alternatively, the left forearm of nursing mother 19 may be inserted from left to right under straps 43 and the left hand used to make adjustments with left hand finger-loop 46 and thereby flex the nursing shield toward or away from the breast area for greater concealment, making adjustments, and for other purposes. It is important to note that the nursing shield 10 may be attached interchangeably, and as frequently as desired to eliminate fatigue or for other purposes, to either the left or right forearm of nursing mother 19, and this may be done without exposing the breast area and infant. The length of straps 43 and the elasticity thereof aid in changing the attachment of nursing shield 10 from one forearm to the other as they are sufficiently long to receive both the left and right forearms at the same time. This construction allows both the left and right forearms of mother 19 to be inserted under straps 43 when it is desired to change the attachment of nursing shield 10 from the right forearm to the left, or vice versa, and then one of the forearms is simply withdrawn thereby leaving the nursing shield 10 attached to the desired remaining forearm. This may be done without substantially changing the position of nursing shield 10 when in use or exposing the breast area. It is also important to note that the nursing shield 10 is on the back side of the forearm and the inner side of the forearm is free to contact the infant directly, and that the remaining arm and hand are free for making adjustments, comforting the infant, and for other purposes.

As is best seen in FIG. 4, the end portions of finger loop straps 45 and 46 are each securely attached at either end to fabric 29 by stitching 47. The visible ends 48 of straps 43 are securely attached to fabric 29, padding 28 and panel 11 by stitching 49 which passes therethrough. The straps 43 extend downward over the lower portion 24 of panel 11, then upward between panels 11 and 12, and the hidden ends 55 are securely attached to panel 11 by stitching 56 which passes therethrough.

Figure 6:
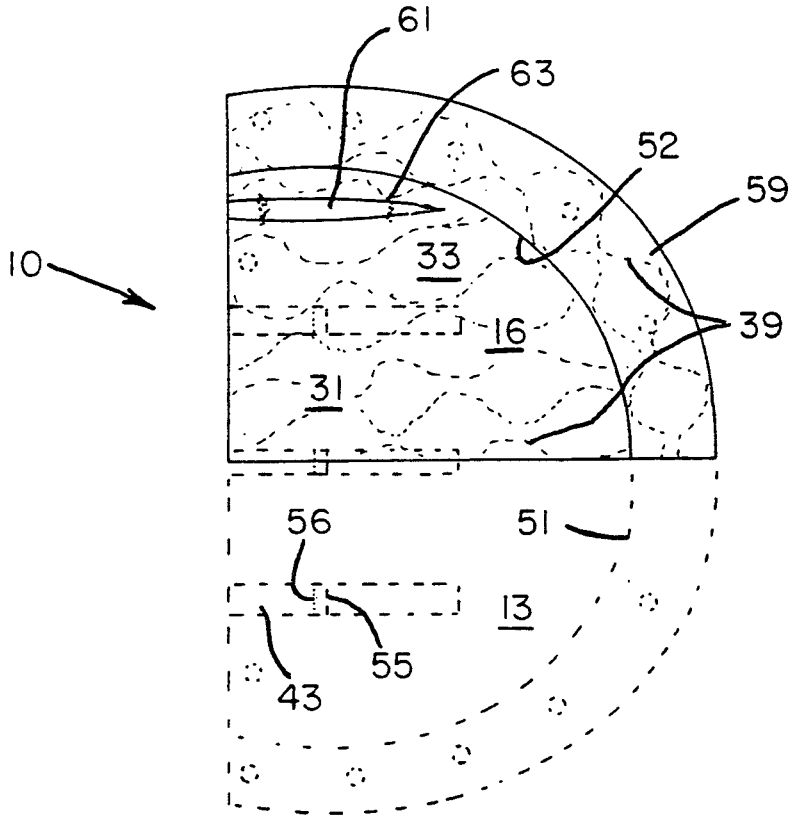
FIG. 6 is a view illustrating folding of the nursing shield of the invention upon itself and fastening the same in the folded position to thereby form a clutch bag.
Figure 7:
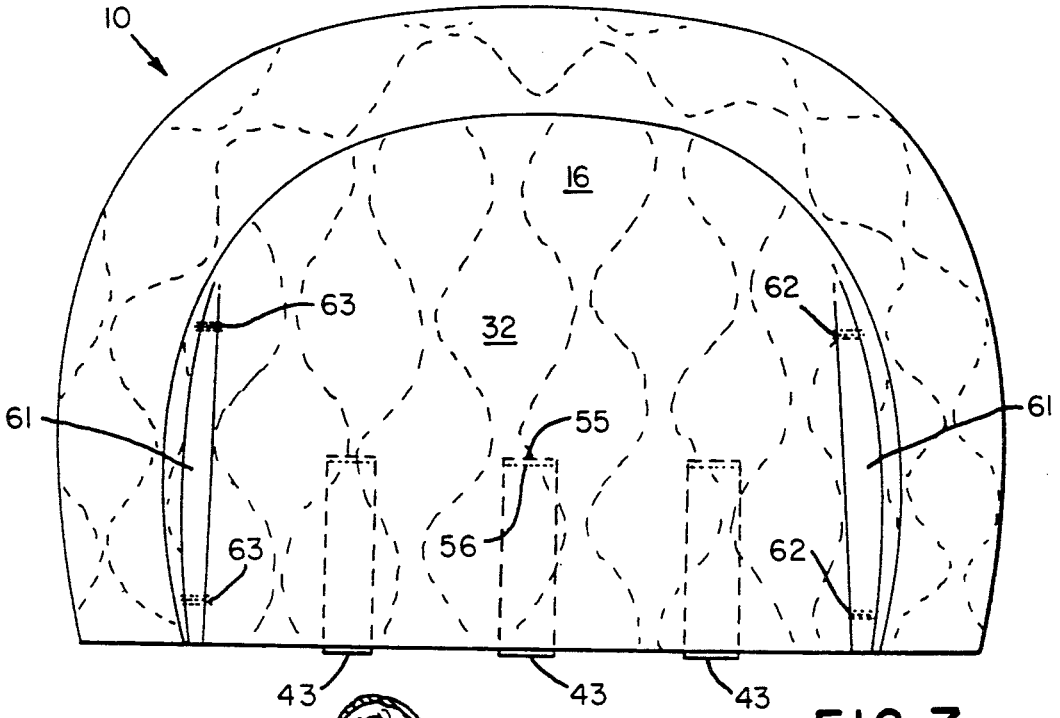
FIG. 7 is a plan view of the outer side of the nursing shield of the invention.
Figure 8:
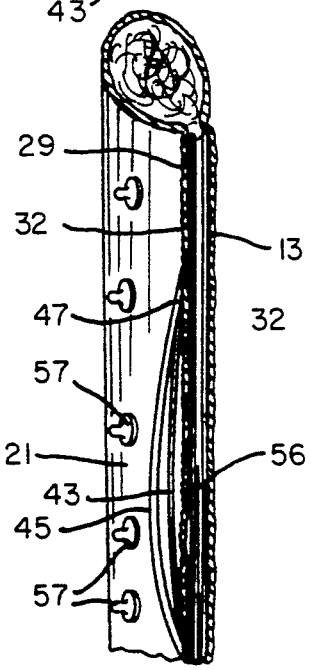
FIG. 8 is a cross-sectional view of the nursing shield of FIG. 1 taken along the lines 8—8 in the direction of the arrows.
Figure 9:
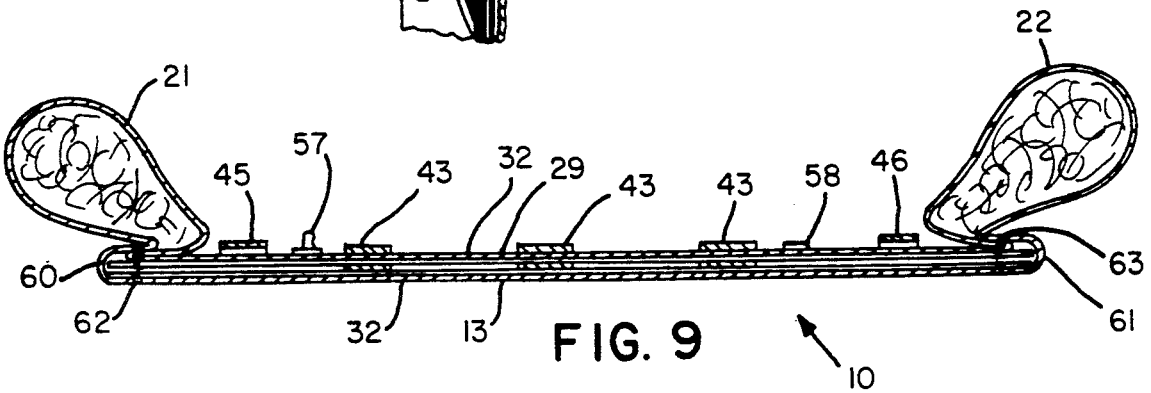
FIG. 9 ia a cross-sectional view of the nursing shield of FIG. 1 taken along the lines 9—9 in the direction of the arrows.

An elongated raised pillow 50 extends around the left, right and upper peripheral portions 21, 22 and 23 of nursing shield 10 for the purpose of increasing concealment of the breast area of nursing mother 19 and infant 20. The pillow 50 includes an outer strip or layer of soft padded quilted fabric 51 which is similar in construction to the above described quilted fabric layers 29 and 31. On the inner side 13, the inner edge 52 of fabric 51 is joined to fabric 29 by stitching or other suitable fastening or attaching means, and on the outer side 16, the outer edge 53 of fabric 51 is similarly joined to fabric 31. The interior of the resulting peripheral tube-like structure is filled with soft padding or filler 54 in an amount sufficient to form an elongated raised or rounded pillow 50 having a cross-sectional area of a size suitable for aiding in concealing the mother 19 and infant 20. The eft and right inner sides of fabric 29 and fabric 51 are provided with cooperating snap halves 57 and 58, respectively, whereby as is best seen in FIG. 6, the nursing shield 10 may be folded inward upon itself and fastened in the folded position to form a clutch bag 59 having an internal available space which is sufficient for carrying articles and clothing needed by the mother 19 and baby 20.

As is best seen in FIG. 3, the lower left and right upright portions of panels 11 and 12, padding 28 and 30, and fabric layers 29 and 31 are folded inward onto the inner side 13 to form left and right upright pleats 60 and 61, respectively, which are held in position by stitching 62 and 63, respectively. The pleats 60 and 61 cause the left and right portions 21 and 22, respectively, of inner side 13 of nursing shield 10 to be raised and cupped inward to thereby increase concealment of a nursing mother 19 and infant 20.

The panels 11 and 12 are normally substantially flat so as to allow nursing shield 10 to be placed on a flat surface and used as a diaper changing pad. The panels 11 and 12 are also sufficiently flexible to be folded inward onto the inner side 13 and form clutch bag 59, as illustrated in FIG. 6. Preferably, the panels 11 and 12 have a "memory", whereby when urged from the normally flat position shown in FIG. 3 to the folded position shown in FIG. 6 and fastened into position by snap halves 57 and 58, the panels 11 and 12 will return to the flat position of FIG. 3 upon releasing the snap halves 57 and 58. Any suitable material of construction having the above properties may be used for panels 11 and 12, but usually plastic materials are preferred. Polyolefin sheet materials prepared from polyethylene, polypropylene and admixtures thereof usually give the best results, but other plastic materials may be used.

The thickness of the panels may vary over wide ranges as it is only necessary that they have sufficient strength to cause the nursing shield 10 to stand out from the arm. The thickness may be, for example, about 1/28 inch to $\frac{3}{8}$ inch, or about 1/64 inch to $\frac{1}{4}$ inch, or about 1/32 inch to $\frac{1}{8}$ inch, or preferably about 1/16 inch. Also, one panel may be used alone if sufficiently thick to have enough strength to cause the nursing shield 10 to stand out from the arm, or alternatively, 2, 3, 4, 5 or more thinner sheets may be superimposed to achieve the desired level of strength. When the panels are plastic, preferably they are in the form of foraminated sheets as the fastening means fpr the straps 43 and finger loops 45 and 46, such as stitching, staples or the like, may be passed through the openings without damaging the sheet. As is well known, cuts or tears in plastic sheets weaken the structure and, upon continued flexing, the life of the sheet is greatly reduced. This may be avoided and the sheet life increased greatly by using foraminated sheets and fastening means that pass through the openings without damage to the sheet.

While certain preferred embodiments of the invention have been specifically illustrated and described herein, it is understood that modifications may be made therein that are within the scope of the invention. The foregoing detailed description and the accompanying drawings are therefore for purposes of illustration only, and are not intended as being limiting to the spirit or scope of the appended claims.

We claim:

1. A nursing shield for use by a nursing mother in the discreet breast feeding of an infant comprising a stiff yet flexible panel means, the panel means of the nursing shield having an inner side which faces toward a nursing mother during use, an outer side which faces away from a nursing mother during use, and left, right, upper and lower portions with respect to a nursing mother during use, attaching means for attaching the nursing shield to the forearm of a nursing mother, said attaching means including means constructed and arranged so that during use of the nursing shield the back side of said forearm is adjacent the said inner side of the nursing shield thereby leaving the inner side of said forearm free to contact the infant during nursing, said panel means being sufficiently stiff to cause the nursing shield to extend out from said forearm when the nursing shield is attached thereto, said panel means being sufficiently flexible to allow a nursing mother to flex the nursing shield toward her breast area and said infant for greater concealment during use of the nursing shield, and the nursing shield being of sufficient size and having a construction and configuration capable of concealing a nursing mother's breast area and said infant's head and upper body during use thereof.

2. The nursing shield of claim 1 wherein said means for attaching the nursing shield to said forearm comprises a plurality of spaced strap means.

3. The nursing shield of claim 1 wherein finger-loop means is provided on said inner side of the nursing shield to enable a nursing mother to flex the nursing shield toward her breast area and said infant for greater concealment.

4. The nursing shield of claim 1 wherein at least said inner side of the panel means is provided with first padding mean for enhancing the comfort of said infant.

5. The nursing shield of claim 1 wherein at least said inner side of the panel means is provided with first padding means for enhancing the comfort of said infant, and second padding means is positioned around at least a portion of the periphery of said first padding means to provide an elongated raised peripheral pillow-like construction effective to increase concealment of the mother's breast area and said infant during use of the nursing shield.

6. The nursing shield of claim 1 wherein said panel means is sufficiently flexible to allow it to be folded upon itself, and cooperating fastening means is provided adjacent the periphery of said inner side of the nursing shield so that when not in use it may be folded upon itself and fastened in the folded position to thereby form an internal compartment for use in storing and transporting articles.

7. The nursing shield of claim 1 wherein lower left and right portions of said panel means are folded inward onto said inner side to form left and right pleats and cause the left and right portions of said inner side of the nursing shield to be raised and cupped inward to thereby increase concealment of a nursing mother's breast area and said infant's head and upper body during use thereof.

8. The nursing shield of claim 1 wherein said panel means comprises at least one plastic panel.

9. The nursing shield of claim 1 wherein said means for attaching the nursing shield to said forearm comprises a plurality of spaced strap means, finger-loop means is provided on said inner side of the nursing shield to enable a nursing mother to flex the nursing shield toward her breast area and said infant for greater concealment, at least said inner side of the panel means is provided with first padding means for enhancing the comfort of said infant, second padding means is positioned around at least a portion of the periphery of said first padding means to provide an elongated raised peripheral pillow-like construction to increase concealment of the mother's breast area and said infant during use of the nursing shield, said panel means is sufficiently flexible to allow it to be folded upon itself, cooperating fastening means is provided adjacent the periphery of said inner side of the nursing shield so that when not in use it may be folded upon itself and fastened in the folded position to thereby form an internal compartment for use in storing and transporting articles, left and right edge portions of said panel means are folded inward onto said inner side to form left and right pleats and cause the left and right side portions of said inner side of the nursing shield to be raised and cupped inward to thereby increase concealment of a nursing mother's breast area and said infant's head and upper body during use thereof, said panel means comprises at least one plastic panel.

10. The nursing shield of claim 1 wherein the said left, right and upper portions of the panel means of the nursing shield have a generally semi-circular configuration.

11. The nursing shield of claim 10 wherein said means for attaching the nursing shield to said forearm comprises a plurality of spaced upright elastic strap means extending upward from the lower portion of the inner side of the nursing shield, said strap means including means constructed and arranged so that the nursing shield may be attached to either the left forearm or the right forearm of a nursing mother.

12. The nursing shield of claim 10 wherein left hand and right hand finger-loop means is provided on said inner side of the nursing shield, said finger-loop means including means constructed and arranged so that a nursing mother may use either the left hand or the right hand to flex the nursing shield toward her breast area and said infant for greater concealment.

13. The nursing shield of claim 10 wherein at least said inner side of the panel means is provided with first padding means for enhancing the comfort of said infant and decorative cover means is provided thereover.

14. The nursing shield of claim 10 wherein both the inner side and the outer side of the panel means are provided with first padding means for enhancing the comfort of said infant, second padding means is positioned around the left, right and upper peripheral portions of said first padding means to provide an elongated raised peripheral pillar-like construction effective to increase concealment of the mother's breast area and said infant during use of the nursing shield, and decorative cover means is provided over the inner and outer sides of the nursing shield.

15. The nursing shield of claim 10 wherein said panel means is sufficiently flexible to allow it to be folded upon itself, and cooperating fastening means is provided around the peripheries of the left, right, upper and lower portions of the nursing shield so that when not in use the nursing shield may be folded upon itself and fastened in the folded position to thereby form an internal compartment for use in storing and transporting articles.

16. The nursing shield of claim 10 wherein left and right portions of said panel means are folded inward onto said inner side to form left and right pleats and cause the left and right portions of said inner side of the nursing shield to be raised and cupped inward to thereby increase concealment of a nursing mother's breast area and said infant's head and upper body during use thereof.

17. The nursing shield of claim 10 wherein said panel means comprises at least one foraminated polyolefin plastic panel.

18. The nursing shield of claim 10 wherein said means for attaching the nursing shield to said forearm comprises a plurality of spaced upright elastic strap means extending upward from the lower portion of the inner side of the nursing shield, said strap means being constructed and arranged so that the nursing shield may be attached to either the left forearm or the right forearm of a nursing mother, left hand and right hand finger-loop means is provided on said inner side of the nursing shield, said finger-loop means being constructed and arranged so that a nursing mother may use either the left hand or the right hand to flex the nursing shield toward her breast area and said infant for greater concealment, both the inner side and the outer side of the panel means being provided with first padding means for enhancing the comfort of said infant, second padding means is positioned around the left, right and upper peripheral portions of said first padding means to provide an elongated raised peripheral pillar-like construction which increases concealment of the mother's breast area and said infant during use of the nursing shield, decorative cover means is provided over the inner and outer sides of the nursing shield, said panel means is sufficiently flexible to allow it to be folded upon itself, cooperating fastening means is provided around the peripheries of the left, right, upper and lower portions of the nursing shield whereby when not in use the nursing shield may be folded upon itself and fastened in the folded position to thereby form an internal compartment for use in storing and transporting articles, left and right portions of said panel means are folded inward onto said inner side to form left and right pleats and cause the left and right portions of said inner side of the nursing shield to be raised and cupped inward to thereby increase concealment of a nursing mother's breast area and said infant's head and upper body during use thereof, and said panel means comprises at least one foraminated polyolefin plastic panel.

* * * * *